US008275610B2

(12) United States Patent
Faller et al.

(10) Patent No.: US 8,275,610 B2
(45) **Date of Patent: *Sep. 25, 2012**

(54) DIALOGUE ENHANCEMENT TECHNIQUES

(75) Inventors: Christof Faller, Chavannes-pres-Renens (CH); Hyen-O Oh, Goyang-si (KR); Yang-Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 1328 days.

This patent is subject to a terminal disclaimer.

(21) Appl. No.: 11/855,500

(22) Filed: Sep. 14, 2007

(65) Prior Publication Data

US 2008/0167864 A1 Jul. 10, 2008

Related U.S. Application Data

(60) Provisional application No. 60/844,806, filed on Sep. 14, 2006, provisional application No. 60/884,594, filed on Jan. 11, 2007, provisional application No. 60/943,268, filed on Jun. 11, 2007.

(51) Int. Cl.
*G10L 19/14* (2006.01)

(52) U.S. Cl. ..... 704/225; 704/233; 704/235; 381/58; 381/17

(58) Field of Classification Search ..... 381/17, 381/27, 61, 62, 63, 309, 310, 58, 59; 704/201, 704/205, 233, 260, 270, 225, 235
See application file for complete search history.

(56) References Cited

U.S. PATENT DOCUMENTS

| | | | | |
|---|---|---|---|---|
| 3,519,925 | A * | 7/1970 | Anstey et al. | 708/817 |
| 4,897,878 | A * | 1/1990 | Boll et al. | 704/233 |
| 5,737,331 | A * | 4/1998 | Hoppal et al. | 370/349 |
| 6,111,755 | A | 8/2000 | Park | |
| 6,243,476 | B1 * | 6/2001 | Gardner | 381/303 |
| 6,470,087 | B1 | 10/2002 | Heo et al. | |
| 6,813,600 | B1 | 11/2004 | Casey, III et al. | |
| 6,990,205 | B1 | 1/2006 | Chen | |
| 7,016,501 | B1 * | 3/2006 | Aylward et al. | 381/22 |
| 7,085,387 | B1 | 8/2006 | Metcalf | |
| 7,307,807 | B1 * | 12/2007 | Han et al. | 360/75 |
| 2002/0116182 | A1 * | 8/2002 | Gao et al. | 704/205 |

(Continued)

FOREIGN PATENT DOCUMENTS

EP 0865227 9/1998

(Continued)

OTHER PUBLICATIONS

European Search Report & Written Opinion for Application No. EP 07858967.8, dated Sep. 10, 2009, 5 pages.

(Continued)

*Primary Examiner* — Vivian Chin
*Assistant Examiner* — Friedrich W Fahnert
(74) *Attorney, Agent, or Firm* — Fish & Richardson P.C.

(57) ABSTRACT

A plural-channel audio signal (e.g., a stereo audio) is processed to modify a gain (e.g., a volume or loudness) of a speech component signal (e.g., dialogue spoken by actors in a movie) relative to an ambient component signal (e.g., reflected or reverberated sound) or other component signals. In one aspect, the speech component signal is identified and modified. In one aspect, the speech component signal is identified by assuming that the speech source (e.g., the actor currently speaking) is in the center of a stereo sound image of the plural-channel audio signal and by considering the spectral content of the speech component signal.

20 Claims, 6 Drawing Sheets

U.S. PATENT DOCUMENTS

| | | | | |
|---|---|---|---|---|
| 2003/0039366 | A1 | 2/2003 | Eid et al. | |
| 2004/0193411 | A1* | 9/2004 | Hui et al. | 704/233 |
| 2005/0117761 | A1 | 6/2005 | Sato | |
| 2005/0152557 | A1* | 7/2005 | Sasaki et al. | 381/58 |
| 2006/0008091 | A1* | 1/2006 | Kim et al. | 381/17 |
| 2006/0029242 | A1 | 2/2006 | Metcalf | |
| 2006/0074646 | A1* | 4/2006 | Alves et al. | 704/226 |
| 2006/0115103 | A1* | 6/2006 | Feng et al. | 381/313 |
| 2006/0139644 | A1* | 6/2006 | Kahn et al. | 356/406 |
| 2006/0159190 | A1* | 7/2006 | Wu et al. | 375/260 |
| 2006/0198527 | A1 | 9/2006 | Chun | |
| 2009/0003613 | A1* | 1/2009 | Christensen | 381/58 |

FOREIGN PATENT DOCUMENTS

| | | |
|---|---|---|
| EP | 1 187 101 | 3/2002 |
| GB | 2353926 | 3/2001 |
| JP | 03-285500 | 12/1991 |
| JP | 04-249484 | 9/1992 |
| JP | 05-183997 | 7/1993 |
| JP | 05-088100 | 11/1993 |
| JP | 05-292592 | 11/1993 |
| JP | 06-070400 | 3/1994 |
| JP | 06-253398 | 9/1994 |
| JP | 06-335093 | 12/1994 |
| JP | 07-115606 | 5/1995 |
| JP | 08-222979 | 8/1996 |
| JP | 11-289600 | 10/1999 |
| JP | 2000-115897 | 4/2000 |
| JP | 2001-245237 | 9/2001 |
| JP | 2001-289878 | 10/2001 |
| JP | 2002-078100 | 3/2002 |
| JP | 2002-101485 | 4/2002 |
| JP | 2002-247699 | 8/2002 |
| JP | 2003-084790 | 3/2003 |
| JP | 2004-343590 | 12/2004 |
| JP | 2005-086462 | 3/2005 |
| JP | 2005-125878 | 5/2005 |
| JP | 3118519 | 1/2006 |
| JP | 2006222686 | 8/2006 |
| RU | 98121130 | 11/1997 |
| WO | 99/04498 | 1/1999 |
| WO | 2005/099304 | 10/2005 |

OTHER PUBLICATIONS

Faller et al., "Binaural Cue Coding—Part II: Schemes and Applications" IEEE Transactions on Speech and Audio Processing, IEEE Service Center, New York, NY, vol. 11, No. 6., Oct. 6, 2003, 12 pages.

International Organization for Standardization, "Concepts of Object-Oriented Spatial Audio Coding", Jul. 21, 2006, 8 pages.

PCT International Search report corresponding to PCT/EP2007/008028, dated Jan. 22, 2008, 4 pages.

PCT International Search Report in corresponding PCT application #PCT/IB2007/003073, dated May 27, 2008, 3 pages.

Notice of Allowance, Russian Application No. 2009113806, mailed Jul. 2, 2010, 16 pages with English translation.

Office Action, Japanese Appln. No. 2009-527747, dated Apr. 6, 2011, 10 pages with English translation.

Office Action, Japanese Appln. No. 2009-527925, dated Apr. 12, 2011, 10 pages with English translation.

Office Action, Japanese Appln. No. 2009-527920, dated Apr. 19, 2011, 10 pages with English translation.

Office Action, U.S. Appl. No. 11/855,570, dated Sep. 20, 2011, 14 pages.

Office Action, U.S. Appl. No. 11/855,576, dated Oct. 12, 2011, 12 pages.

* cited by examiner

DIALOGUE ENHANCEMENT TECHNIQUES

RELATED APPLICATIONS

This patent application claims priority to the following co-pending U.S. Provisional patent applications:

- U.S. Provisional Patent Application No. 60/844,806, for "Method of Separately Controlling Dialogue Volume," filed Sep. 14, 2006;
- U.S. Provisional Patent Application No. 60/884,594, for "Separate Dialogue Volume (SDV)," filed Jan. 11, 2007; and
- U.S. Provisional Patent Application No. 60/943,268, for "Enhancing Stereo Audio with Remix Capability and Separate Dialogue," filed Jun. 11, 2007.

Each of these provisional patent applications are incorporated by reference herein in its entirety.

TECHNICAL FIELD

The subject matter of this patent application is generally related to signal processing.

BACKGROUND

Audio enhancement techniques are often used in home entertainment systems, stereos and other consumer electronic devices to enhance bass frequencies and to simulate various listening environments (e.g., concert halls). Some techniques attempt to make movie dialogue more transparent by adding more high frequencies, for example. None of these techniques, however, address enhancing dialogue relative to ambient and other component signals.

SUMMARY

A plural-channel audio signal (e.g., a stereo audio) is processed to modify a gain (e.g., a volume or loudness) of a speech component signal (e.g., dialogue spoken by actors in a movie) relative to an ambient component signal (e.g., reflected or reverberated sound) or other component signals. In one aspect, the speech component signal is identified and modified. In one aspect, the speech component signal is identified by assuming that the speech source (e.g., the actor currently speaking) is in the center of a stereo sound image of the plural-channel audio signal and by considering the spectral content of the speech component signal.

Other implementations are disclosed, including implementations directed to methods, systems and computer-readable mediums.

DETAILED DESCRIPTION

Dialogue Enhancement Techniques

Figure 1:
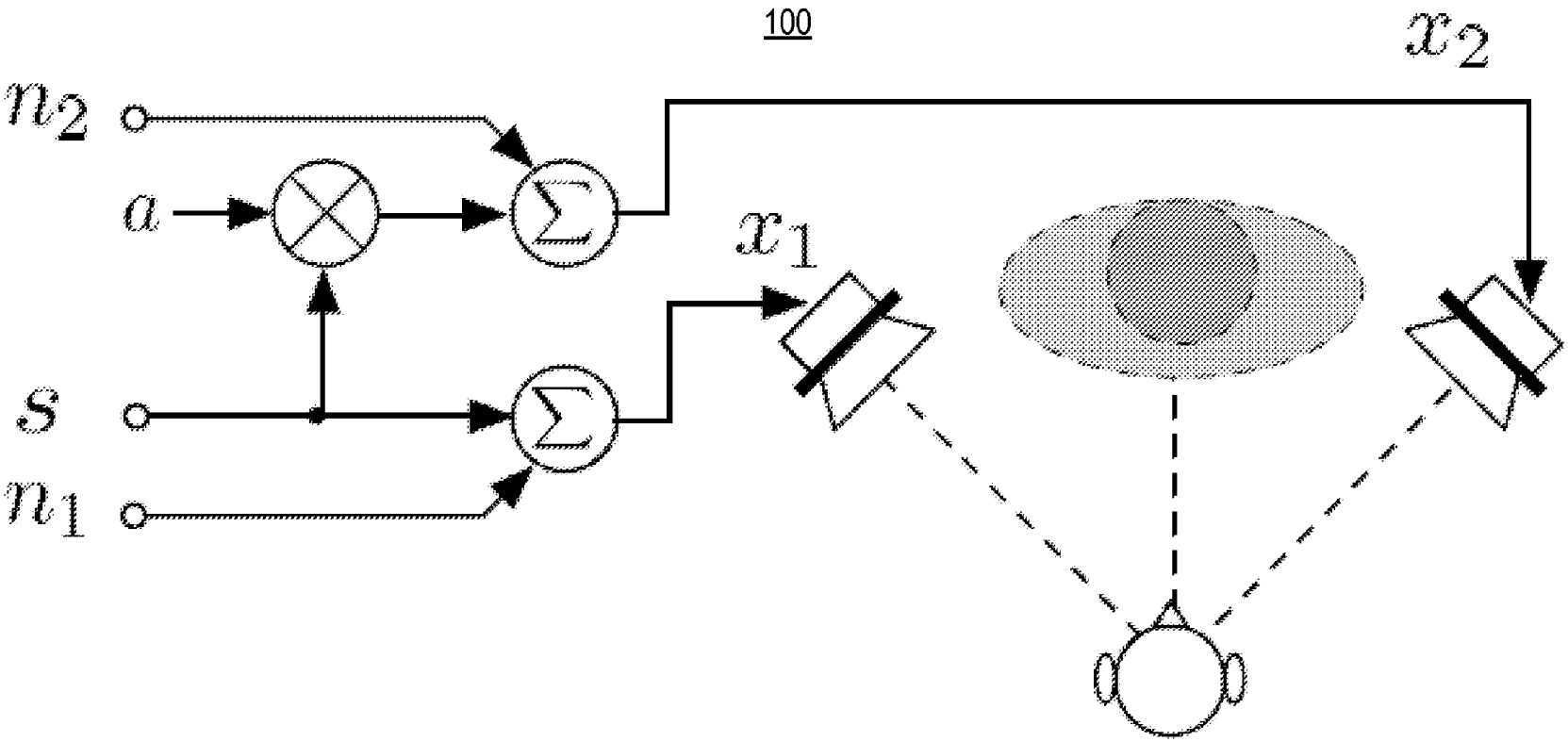
FIG. 1 is block diagram of a mixing model for dialogue enhancement techniques.

FIG. 1 is block diagram of a mixing model 100 for dialogue enhancement techniques. In the model 100, a listener receives audio signals from left and right channels. An audio signal s corresponds to localized sound from a direction determined by a factor a. Independent audio signals $n_1$ and $n_2$, correspond to laterally reflected or reverberated sound, often referred to as ambient sound or ambience. Stereo signals can be recorded or mixed such that for a given audio source the source audio signal goes coherently into the left and right audio signal channels with specific directional cues (e.g., level difference, time difference), and the laterally reflected or reverberated independent signals $n_1$ and $n_2$ go into channels determining auditory event width and listener envelopment cues. The model 100 can be represented mathematically as a perceptually motivated decomposition of a stereo signal with one audio source capturing the localization of the audio source and ambience.

$$x_1(n)=s(n)+n_1(n)$$

$$x_2(n)=as(n)+n_2(n) \quad [1]$$

To get a decomposition that is effective in non-stationary scenarios with multiple concurrently active audio sources, the decomposition of [1] can be carried out independently in a number of frequency bands and adaptively in time $$X_1(i,k)=S(i,k)+N_1(i,k)$$

$$X_2(i,k)=A(i,k)S(i,k)+N_2(i,k), \quad [2]$$

where i is a subband index and k is a subband time index.

Figure 2:
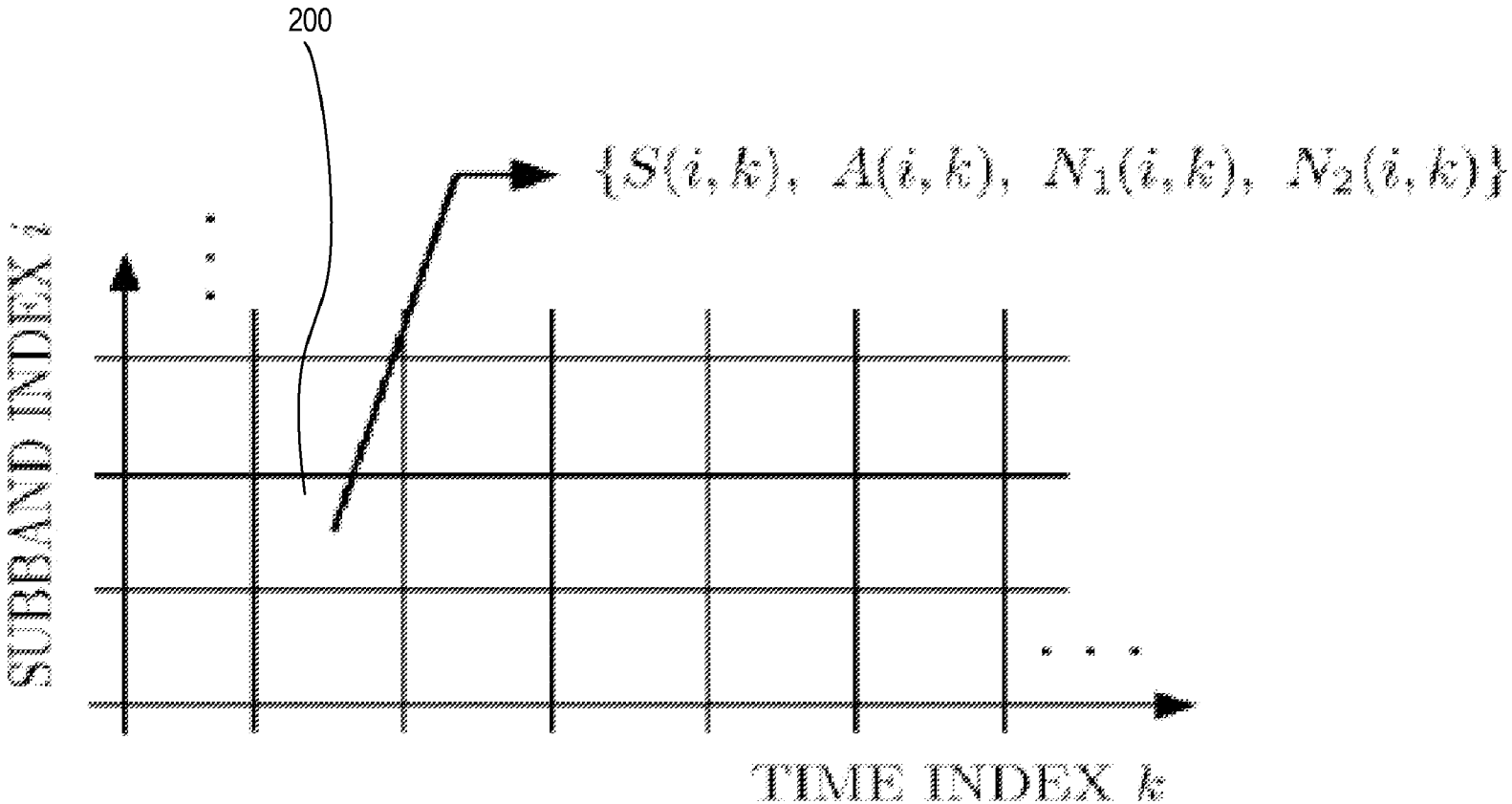
FIG. 2 is a graph illustrating a decomposition of stereo signals using time-frequency tiles.

FIG. 2 is a graph illustrating a decomposition of a stereo signal using time-frequency tiles. In each time-frequency tile 200 with indices i and k, the signals S, $N_1$, $N_2$ and decomposition gain factor A can be estimated independently. For brevity of notation, the subband and time indices i and k are ignored in the following description.

When using a subband decomposition with perceptually motivated subband bandwidths, the bandwidth of a subband can be chosen to be equal to one critical band. S, $N_1$, $N_2$, and A can be estimated approximately every t milliseconds (e.g., 20 ms) in each subband. For low computation complexity, a short time Fourier transform (STFT) can be used to implement a fast Fourier transform (FFT). Given stereo subband signals, $X_1$ and $X_2$, estimates of S, A, $N_1$, $N_2$ can be determined. A short-time estimate of a power of $X_1$ can be denoted $$P_{X1}(i,k)=E\{X_1^2(i,k)\}, \quad [3]$$

where $E\{.\}$ is a short-time averaging operation. For other signals, the same convention can be used, i.e., $P_{X2}$, $P_S$ and $P_N=P_{N1}=P_{N2}$ are the corresponding short-time power estimates. The power of $N_1$ and $N_2$ is assumed to be the same, i.e., it is assumed that the amount of lateral independent sound is the same for left and right channels.

Estimating $P_S$, A and $P_N$

Given the subband representation of the stereo signal, the power ($P_{X1}$, $P_{X2}$) and the normalized cross-correlation can be determined. The normalized cross-correlation between left and right channels is $$\Phi(i,k)=\frac{E\{X_1(i,k)X_2(i,k)\}}{\sqrt{E\{X_1^2(i,k)E\{X_2^2(i,k)\}}}. \quad [4]$$

A, $P_S$, $P_N$ can be computed as a function of the estimated $P_{X1}$, $P_{X2}$, and $\Phi$. Three equations relating the known and unknown variables are:

$$P_{X1}=P_S+P_N \quad [5]$$
$$P_{X2}=A^2P_S+P_N$$
$$\Phi=\frac{aP_S}{\sqrt{P_{X1}P_{X2}}}.$$

Equations [5] can be solved for A, $P_S$, and $P_N$, to yield $$A=\frac{B}{2C} \quad [6]$$
$$P_S=\frac{2C^2}{B}$$
$$P_N=X_1-\frac{2C^2}{B},$$

with $$B=P_{X2}-P_{X1}+\sqrt{(P_{X1}-P_{X2})^2+4P_{X1}P_{X2}\Phi^2} \quad [7]$$
$$C=\Phi\sqrt{P_{X1}P_{X2}}.$$

Least Squares Estimation of S, $N_1$, and $N_2$

Next, the least squares estimates of S, $N_1$ and $N_2$ are computed as a function of A, $P_S$, and $P_N$. For each i and k, the signal S can be estimated as $$\hat{S}=w_1X_1+w_2X_2=w_1(S+N_1)+w_2(AS+N_2), \quad [8]$$

where $w_1$ and $w_2$ are real-valued weights. The estimation error is $$E=(1-w_1-w_2A)S-w_1N_1-w_2N_2. \quad [9]$$

The weights $w_1$ and $w_2$ are optimal in a least square sense when the error E is orthogonal to $X_1$ and $X_2$[6], i.e., $$E\{EX_1\}=0$$
$$E\{EX_2\}=0, \quad [10]$$

yielding two equations $$(1-w_1-w_2A)P_S-w_1P_N=0$$
$$A(1-w_1-w_2A)P_S-w_2P_N=0, \quad [11]$$

from which the weights are computed, $$w_1=\frac{P_SP_N}{(A^2+1)P_SP_N+P_N^2} \quad [12]$$
$$w_2=\frac{AP_SP_N}{(A^2+1)P_SP_N+P_N^2}.$$

The estimate of $N_1$ can be $$\hat{N}_1=w_3X_1+w_4X_2=w_3(S+N_1)+w_4(AS+N_2). \quad [13]$$

The estimation error is $$E=(-w_3-w_4A)S-(1-w_3)N_1-w_2N_2. \quad [14]$$

Again, the weights are computed such that the estimation error is orthogonal to $X_1$ and $X_2$, resulting in $$w_3=\frac{A^2P_SP_N+P_N^2}{(A^2+1)P_SP_N+P_N^2} \quad [15]$$
$$w_4=\frac{-AP_SP_N}{(A^2+1)P_SP_N+P_N^2}.$$

The weights for computing the least squares estimate of $N_2$, $$\hat{N}_2=w_5X_1+w_6X_2 \quad [16]$$
$$=w_5(S+N_1)+w_6(AS+N_2),$$

are $$w_5=\frac{-AP_SP_N}{(A^2+1)P_SP_N+P_N^2} \quad [17]$$
$$w_6=\frac{P_SP_N+P_N^2}{(A^2+1)P_SP_N+P_N^2}.$$

Post-Scaling $$\hat{S},\hat{N}_1,\hat{N}_2$$

In some implementations, the least squares estimates can be post-scaled, such that the power of the estimates equals to $P_S$ and $P_N=P_{N1}=P_{N2}$. The power of $\hat{S}$ is $$P_{\hat{S}}=(w_1+aw_2)^2P_S+(w_1^2+w_2^2)P_N. \quad [18]$$

Thus, for obtaining an estimate of S with power $P_S$, $\hat{S}$ is scaled $$\hat{S}'=\frac{\sqrt{P_S}}{\sqrt{(w_1+aw_2)^2P_S+(w_1^2+w_2^2)P_N}}\hat{S}. \quad [19]$$

With similar reasoning, $\hat{N}_1$ and $\hat{N}_2$ are scaled $$\hat{N}_1'=\frac{\sqrt{P_N}}{\sqrt{(w_3+aw_4)^2P_S+(w_3^2+w_4^2)P_N}}\hat{N}_1 \quad [20]$$
$$\hat{N}_2'=\frac{\sqrt{P_N}}{\sqrt{(w_5+aw_6)^2P_S+(w_5^2+w_6^2)P_N}}\hat{N}_2.$$

Stereo Signal Synthesis

Given the previously described signal decomposition, a signal that is similar to the original stereo signal can be obtained by applying [2] at each time and for each subband and converting the subbands back to the time domain.

For generating the signal with modified dialogue gain, the subbands are computed as $$Y_1(i,k) = 10^{\frac{g(i,k)}{20}} S(i,k) + N_1(i,k) \quad [21]$$

$$Y_2(i,k) = 10^{\frac{g(i,k)}{20}} A(i,k) S(i,k) + N_2(i,k),$$

where g(i,k) is a gain factor in dB which is computed such that the dialogue gain is modified as desired.

There are several observations which motivate how to compute g(i,k):

- Usually dialogue is in the center of the sound image, i.e., a component signal at time k and frequency i belonging to dialogue will have a corresponding decomposition gain factor A(i,k) close to one (0 dB).
- Speech signals contain most energy up to 4 kHz. Above 8 kHz speech contains virtually no energy.
- Speech usually also does not contain very low frequencies (e.g., below about 70 Hz).

These observations imply g(i,k) is set to 0 dB at very low frequencies and above 8 kHz, to potentially modify the stereo signal as little as possible. At other frequencies, g(i,k) is controlled as a function of the desired dialogue gain $G_d$ and A(i,k):

$$g(i,k)=f(G_d, A(i,k)). \quad [22]$$

Figure 3A:
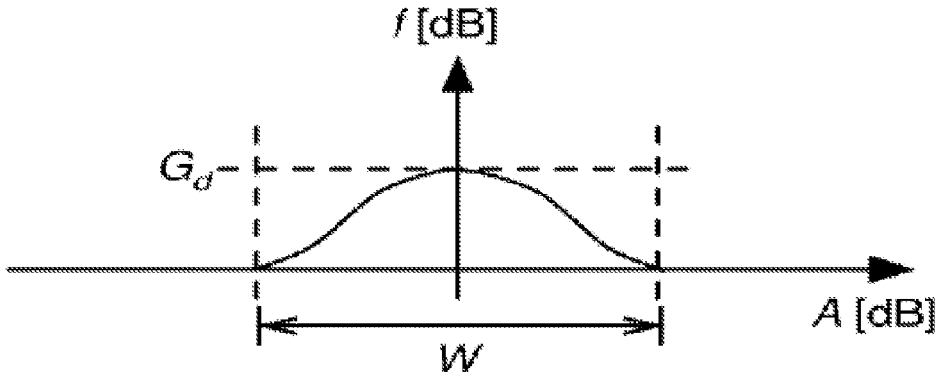
FIG. 3A is a graph of a function for computing a gain as a function of a decomposition gain factor for dialogue that is centered in a sound image.

An example of a suitable function f is illustrated in FIG. 3A. Note that in FIG. 3A the relation between $f$ and A(i,k) is plotted using logarithmic (dB) scale, but A(i,k) and $f$ are otherwise defined in linear scale. A specific example for $f$ is:

$$g(i,k) = 1 + \left(10^{\frac{G_d}{20}} - 1\right)\cos\left(\min\left\{\frac{\pi|10\log_{10}(A(i,k)|}{W}, \frac{\pi}{2}\right\}\right), \quad [23]$$

where W determines the width of a gain region of the function $f$, as illustrated in FIG. 3A. The constant W is related to the directional sensitivity of the dialogue gain. A value of W=6 dB, for example, gives good results for most signals. But it is noted that for different signals different W may be optimal.

Figure 3B:
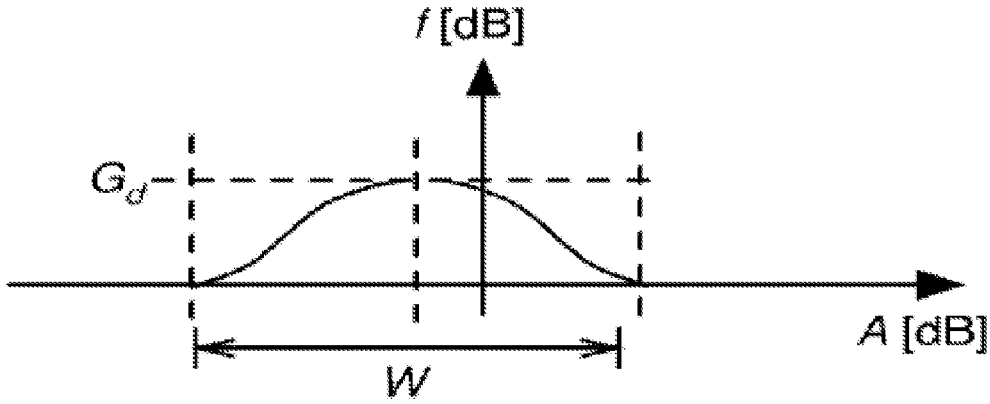
FIG. 3B is a graph of a function for computing gain as a function of a decomposition gain factor for dialogue which is not centered.

Due to bad calibration of a broadcasting or receiving equipment (e.g., different gains for left and right channels), it may be that the dialogue does not appear exactly in the center. In this case, the function $f$ can be shifted such that its center corresponds to the dialogue position. An example of a shifted function $f$ is illustrated in FIG. 3B.

Alternative Implementations and Generalizations

The identification of dialogue component signals based on center-assumption (or generally position-assumption) and spectral range of speech is simple and works well in many cases. The dialogue identification, however, can be modified and potentially improved. One possibility is to explore more features of speech, such as formants, harmonic structure, transients to detect dialogue component signals.

As noted, for different audio material a different shape of the gain function (e.g., FIGS. 3A and 3B) may be optimal. Thus, a signal adaptive gain function may be used.

Dialogue gain control can also be implemented for home cinema systems with surround sound. One important aspect of dialogue gain control is to detect whether dialogue is in the center channel or not. One way of doing this is to detect if the center has sufficient signal energy such that it is likely that dialogue is in the center channel. If dialogue is in the center channel, then gain can be added to the center channel to control the dialogue volume. If dialogue is not in the center channel (e.g., if the surround system plays back stereo content), then a two-channel dialogue gain control can be applied as previously described in reference to FIGS. 1-3.

In some implementations, the disclosed dialogue enhancement techniques can be implemented by attenuating signals other than the speech component signal. For example, a plural-channel audio signal can include a speech component signal (e.g., a dialogue signal) and other component signals (e.g., reverberation). The other component signals can be modified (e.g., attenuated) based on a location of the speech component signal in a sound image of the plural-channel audio signal and the speech component signal can be left unchanged.

Dialogue Enhancement System

Figure 4:
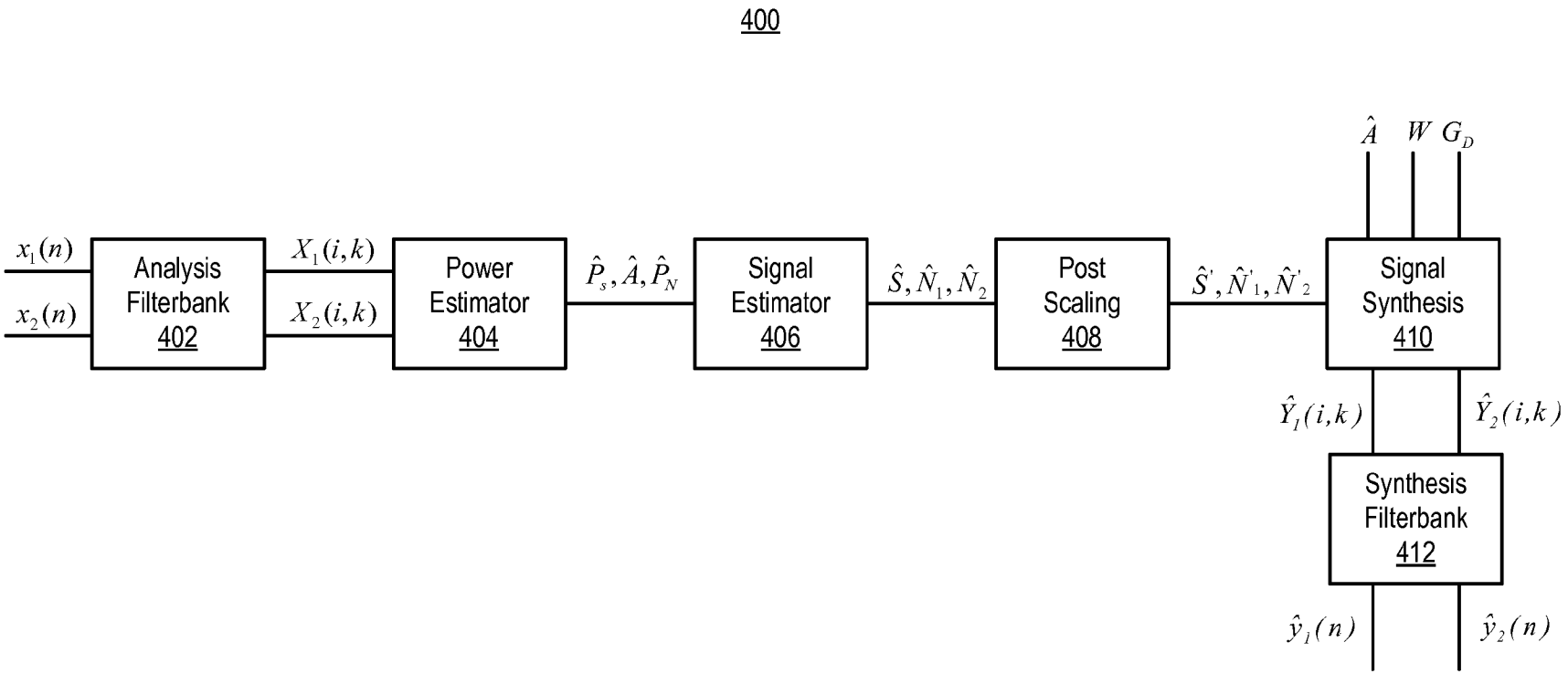
FIG. 4 is a block diagram of an example dialogue enhancement system.

FIG. 4 is a block diagram of an example dialogue enhancement system 400. In some implementations, the system 400 includes an analysis filterbank 402, a power estimator 404, a signal estimator 406, a post-scaling module 408, a signal synthesis module 410 and a synthesis filterbank 412. While the components 402-412 of system 400 are shown as a separate processes, the processes of two or more components can be combined into a single component.

For each time k, a plural-channel signal by the analysis filterbank 402 into subband signals i. In the example shown, left and right channels $x_1(n)$, $x_2(n)$ of a stereo signal are decomposed by the analysis filterbank 402 into i subbands $X_2(i,k)$. The power estimator 404 generates power estimates of $\hat{P}_s$, $\hat{A}$, and $\hat{P}_N$, which have been previously described in reference to FIGS. 1 and 2. The signal estimator 406 generates the estimated signals $\hat{S}$, $\hat{N}_1$, and $\hat{N}_2$ from the power estimates. The post-scaling module 408 scales the signal estimates to provide $\hat{S}'$, $\hat{N}'_1$, and $\hat{N}'_2$. The signal synthesis module 410 receives the post-scaled signal estimates and decomposition gain factor A, constant W and desired dialogue gain $G_d$, and synthesizes left and right subband signal estimates $\hat{Y}_1(i,k)$ and $\hat{Y}_2(i,k)$ which are input to the synthesis filterbank 412 to provide left and right time domain signals $\hat{y}_1(n)$ and $\hat{y}_2(n)$ with modified dialogue gain based on $G_d$.

Dialogue Enhancement Process

Figure 5:
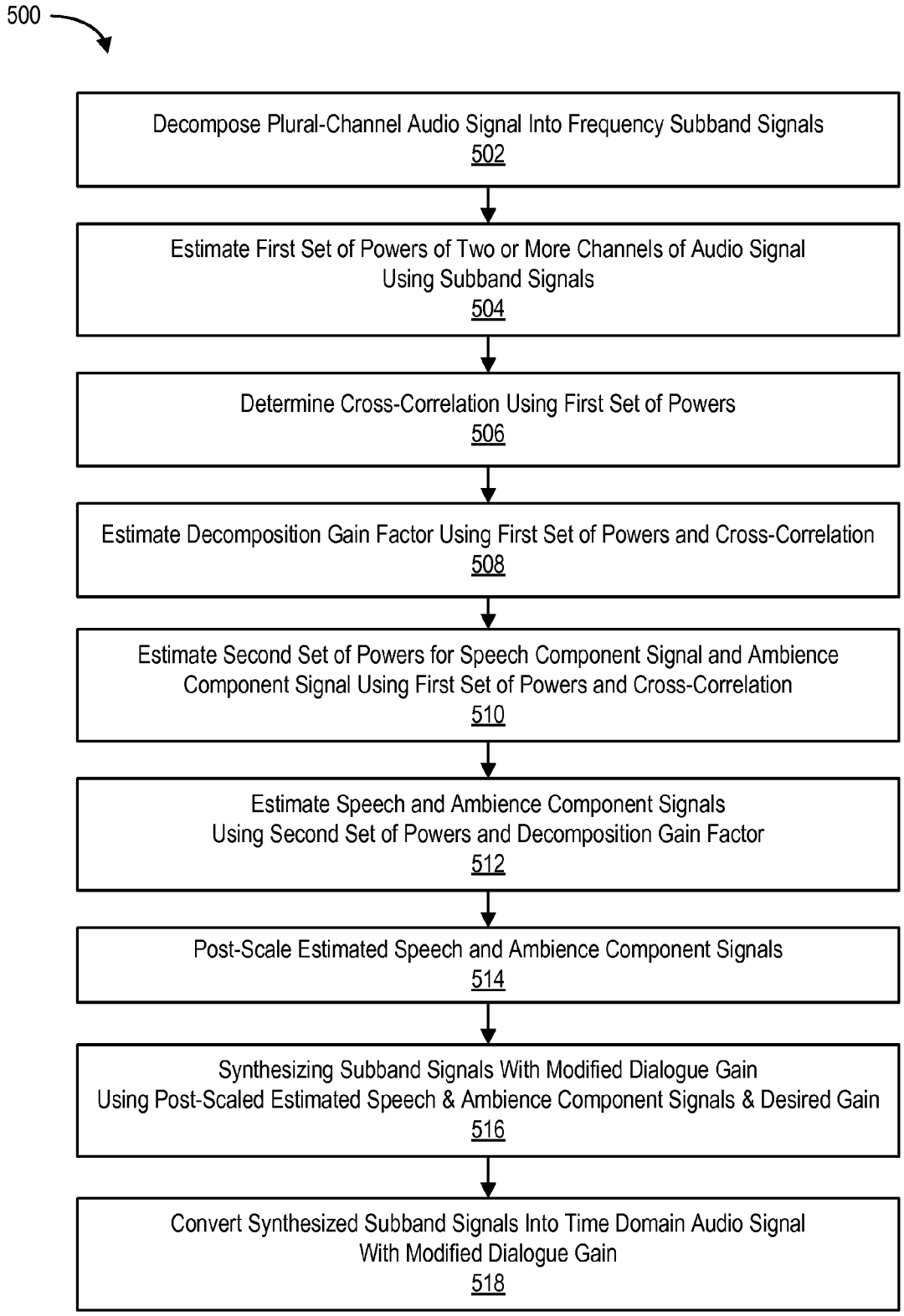
FIG. 5 is a flow diagram of an example dialogue enhancement process.

FIG. 5 is a flow diagram of an example dialogue enhancement process 500. In some implementations, the process 500 begins by decomposing a plural-channel audio signal into frequency subband signals (502). The decomposition can be performed by a filterbank using various known transforms, including but not limited to: polyphase filterbank, quadrature mirror filterbank (QMF), hybrid filterbank, discrete Fourier transform (DFT), and modified discrete cosine transform (MDCT).

A first set of powers of two or more channels of the audio signal are estimated using the subband signals (504). A cross-correlation is determined using the first set of powers (506). A decomposition gain factor is estimated using the first set of powers and the cross-correlation (508). The decomposition gain factor provides a location cue for the dialogue source in the sound image. A second set of powers for a speech component signal and an ambience component signal are estimated using the first set of powers and the cross-correlation (510). Speech and ambience component signals are estimated using the second set of powers and the decomposition gain factor (512). The estimated speech and ambience component signals are post-scaled (514). Subband signals are synthesized with modified dialogue gain using the post-scaled estimated speech and ambience component signals and a desired dialogue gain (516). The desired dialogue gain can be set automatically or specified by a user. The synthesized subband signals are converted into a time domain audio signal with modified dialogue gain (512) using a synthesis filterbank, for example.

Output Normalization for Background Suppression

In some implementations, it is desired to suppress audio of background scenes rather than boosting the dialogue signal. This can be achieved by normalizing the dialogue-boosted output signal with dialogue gain. The normalization can be performed in at least two different ways. In one example, the output signal $\hat{Y}_1(i,k)$ and $\hat{Y}_2(i,k)$ can be normalized by a normalization factor $g_{norm}$:

$$\hat{Y}_1(i,k) = \frac{Y_1(i,k)}{g_{norm}} \qquad [24]$$

$$\hat{Y}_2(i,k) = \frac{Y_2(i,k)}{g_{norm}}.$$

The another example, the dialogue boosting effect is compensated by normalizing using weights $w_1$-$w_6$ with $g_{norm}$. The normalization factor $g_{norm}$ can take the same value as the modified dialogue gain $$10^{\frac{g(i,k)}{20}}.$$

To maximize the perceptual quality, $g_{norm}$ can be modified. The normalization can be performed both in frequency domain and in time domain. When it is performed in frequency domain, the normalization can be performed for the frequency band where dialogue gain applies, for example, between 70 Hz and 8 KHz.

Alternatively, a similar result can be achieved as attenuating $N_1(i,k)$ and $N_2(i,k)$ while applying no gain to $S(i,k)$. This concept can be described with the following equations:

$$\hat{Y}_1(i,k) = S(i,k) + 10^{\frac{g_{atten}(i,k)}{20}} N_1(i,k), \qquad [25]$$

$$\hat{Y}_2(i,k) = S(i,k) + 10^{\frac{g_{atten}(i,k)}{20}} N_2(i,k).$$

Using Separate Dialogue Volume Based on Mono Detection

When input signals $X_1(i,k)$ and $X_2(i,k)$ are substantially similar, e.g., input is a mono-like signal, almost every portion of input might be regarded as S, and when a user provides a desired dialogue gain, the desired dialogue gain increases the volume of the signal. To prevent this, it is desirable to user a separate dialogue volume (SDV) technique to observe the characteristics of the input signals.

In [4], the normalized cross-correlation of stereo signals is calculated. The normalized cross-correlation can be used as a metric for mono signal detection. When phi in [4] exceeds a given threshold, the input signal can be regarded as a mono signal, and separate dialogue volume can be automatically turned off. By contrast, when phi is smaller than a given threshold, the input signal can be regarded as a stereo signal, and separate dialogue volume can be automatically turned on. The dialogue gain can be operated as an algorithmic switch for separate dialogue volume as:

$$\hat{g}(i,k)=1, \text{ for } \phi>Thr_{mono},$$

$$\hat{g}(i,k)=g(i,k), \phi<Thr_{stereo}. \qquad [26]$$

Moreover, when $\phi$ is between $Thr_{mono}$ and $Thr_{stereo}$, (i,k) can be represented as a function of $\phi$:

$$\hat{g}(i,k)=f(\phi,g(i,k)), \text{ for } Thr_{mono}>\phi>Thr_{stereo}. \qquad [27]$$

One example is to apply weighting for $\hat{g}(i,k)$ inverse-proportionality to $\phi$ as $$\hat{g}(i,k) = \frac{-\phi + Thr_{mono}}{Thr_{mono} - Thr_{stereo}} g(i,k), \quad for\ Thr_{mono} > \phi > Thr_{stereo}. \qquad [28]$$

To prevent sudden change of $\hat{g}(i,k)$, time smoothing techniques can be incorporated to get $\hat{g}(i,k)$.

Digital Television System Example

Figure 6:
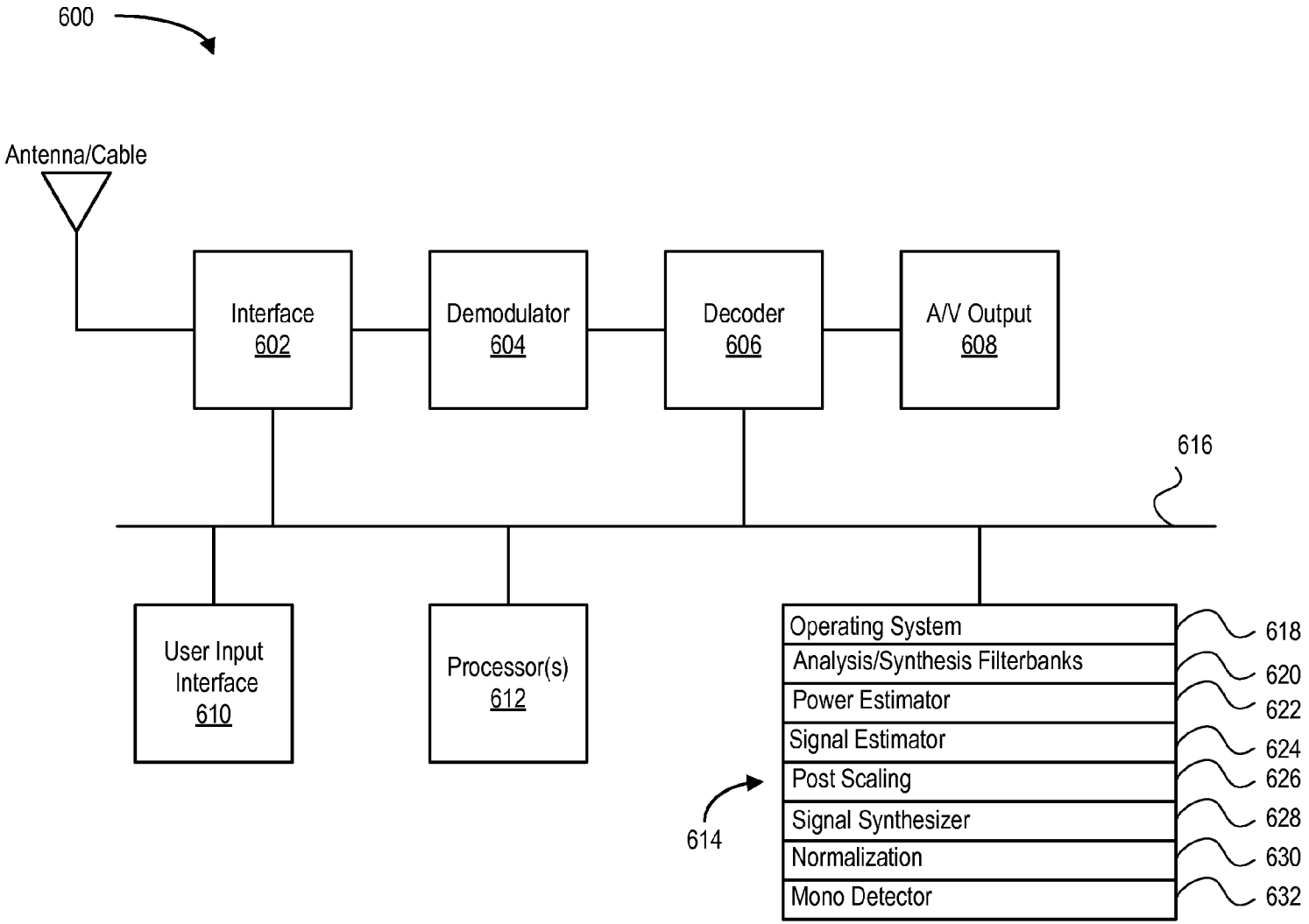
FIG. 6 is a block diagram of a digital television system for implementing the features and processes described in reference to FIGS. 1-5.

FIG. 6 is a block diagram of a an example digital television system 600 for implementing the features and processes described in reference to FIGS. 1-5. Digital television (DTV) is a telecommunication system for broadcasting and receiving moving pictures and sound by means of digital signals. DTV uses digital modulation data, which is digitally compressed and requires decoding by a specially designed television set, or a standard receiver with a set-top box, or a PC fitted with a television card. Although the system in FIG. 6 is a DTV system, the disclosed implementations for dialogue enhancement can also be applied to analog TV systems or any other systems capable of dialogue enhancement.

In some implementations, the system 600 can include an interface 602, a demodulator 604, a decoder 606, and audio/visual output 608, a user input interface 610, one or more processors 612 (e.g., Intel® processors) and one or more computer readable mediums 614 (e.g., RAM, ROM, SDRAM, hard disk, optical disk, flash memory, SAN, etc.). Each of these components are coupled to one or more communication channels 616 (e.g., buses). In some implementations, the interface 602 includes various circuits for obtaining an audio signal or a combined audio/video signal. For example, in an analog television system an interface can include antenna electronics, a tuner or mixer, a radio frequency (RF) amplifier, a local oscillator, an intermediate frequency (IF) amplifier, one or more filters, a demodulator, an audio amplifier, etc. Other implementations of the system 600 are possible, including implementations with more or fewer components.

The tuner 602 can be a DTV tuner for receiving a digital televisions signal include video and audio content. The demodulator 604 extracts video and audio signals from the digital television signal. If the video and audio signals are encoded (e.g., MPEG encoded), the decoder 606 decodes those signals. The A/V output can be any device capable of display video and playing audio (e.g., TV display, computer monitor, LCD, speakers, audio systems).

In some implementations, dialogue volume levels can be displayed to the user using a display device on a remote controller or an On Screen Display (OSD), for example. The dialogue volume level can be relative to the master volume level. One or more graphical objects can be used for displaying dialogue volume level, and dialogue volume level relative to master volume. For example, a first graphical object (e.g., a bar) can be displayed for indicating master volume and a second graphical object (e.g., a line) can be displayed with or composited on the first graphical object to indicate dialogue volume level.

In some implementations, the user input interface can include circuitry (e.g., a wireless or infrared receiver) and/or software for receiving and decoding infrared or wireless signals generated by a remote controller. A remote controller can include a separate dialogue volume control key or button, or a separate dialogue volume control select key for changing the state of a master volume control key or button, so that the master volume control can be used to control either the master volume or the separated dialogue volume. In some implementations, the dialogue volume or master volume key can change its visible appearance to indicate its function.

An example controller and user interface are described in U.S. patent application Ser. No. 11/855,570, for "Controller and User Interface For Dialogue Enhancement Techniques," filed Sep. 14, 2007, which patent application is incorporated by reference herein in its entirety.

In some implementations, the one or more processors can execute code stored in the computer-readable medium 614 to implement the features and operations 618, 620, 622, 624, 626, 628, 630 and 632, as described in reference to FIGS. 1-5.

The computer-readable medium further includes an operating system 618, analysis/synthesis filterbanks 620, a power estimator 622, a signal estimator 624, a post-scaling module 626 and a signal synthesizer 628. The term "computer-readable medium" refers to any medium that participates in providing instructions to a processor 612 for execution, including without limitation, non-volatile media (e.g., optical or magnetic disks), volatile media (e.g., memory) and transmission media. Transmission media includes, without limitation, coaxial cables, copper wire and fiber optics. Transmission media can also take the form of acoustic, light or radio frequency waves.

The operating system 618 can be multi-user, multiprocessing, multitasking, multithreading, real time, etc. The operating system 618 performs basic tasks, including but not limited to: recognizing input from the user input interface 610; keeping track and managing files and directories on computer-readable medium 614 (e.g., memory or a storage device); controlling peripheral devices; and managing traffic on the one or more communication channels 616.

The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language (e.g., Objective-C, Java), including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors or cores, of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network. The relationship of client and server arises by virtue of computer programs running on the respective computers and having a client-server relationship to each other.

A number of implementations have been described. Nevertheless, it will be understood that various modifications may be made. For example, elements of one or more implementations may be combined, deleted, modified, or supplemented to form further implementations. As yet another example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method comprising:

obtaining a plural-channel audio signal including a speech component signal and other component signals;

determining gain values for at least two channels of the plural-channel audio signal, each gain value representing a level for different one channel of the at least two channels;

determining a cross-correlation between the at least two channels;

determining a spatial location of the speech component signal using at least one of the cross-correlation and the gain values;

identifying the speech component signal based on the spatial location of the speech component signal;

modifying the speech component signal by applying a gain factor to the speech component signal; and generating a modified audio signal including the modified speech component signal.

2. The method of claim 1, where modifying the speech component signal further comprises:

modifying the speech component signal based on a spectral range of the speech component signal.

3. The method of claim 1, where the gain factor is a function of the location of the speech component signal and a desired gain for the speech component signal, and where the function is a signal adaptive gain function having a gain region that is related to a directional sensitivity of the gain factor.

4. The method of claim 3, further comprising:

normalizing the plural-channel audio signal with a normalization factor in a time domain or a frequency domain.

5. The method of claim 1, further comprising:

determining if the audio signal is substantially mono; and if the audio signal is not substantially mono, automatically modifying the speech component signal.

6. The method of claim 1, further comprising:

comparing the cross-correlation with one or more threshold values;

determining whether the plural-channel audio signal is substantially mono based on results of the comparison; and modifying the speech component signal when the plural-channel audio signal is not substantially mono.

7. The method of claim 1, further comprising:

decomposing the plural-channel audio signal into a number of frequency subband signals, wherein:

determining the gain values comprises estimating a first set of powers for the at least two channels using the subband signals, determining the cross-correlation comprises determining the cross-correlation using the first set of estimated powers, and determining the spatial location of the speech component signal comprises estimating a decomposition gain factor using the first set of estimated powers and the cross-correlation, wherein the decomposition gain factor provides a location cue of the speech component signal.

8. The method of claim 6, further comprising:

estimating a second set of powers for the speech component signal and an ambience component signal from the first set of powers and the cross-correlation wherein another component signal includes the ambience component signal.

9. The method of claim 8, further comprising:

estimating the speech component signal and the ambience component signal using the second set of powers and a decomposition gain factor.

10. The method of claim 9, where the estimated speech and ambience component signals are determined using least squares estimation.

11. The method of claim 10, where the estimated speech component signal and the estimated ambience component signal are post-scaled.

12. The method of claim 9, further comprising:

synthesizing subband signals using the estimated second powers and a user-specified gain.

13. The method of claim 9, further comprising:

converting a synthesized subband signal into a time domain audio signal having a speech component signal which is modified by a user-specified gain.

14. The method of claim 1, further comprising:

decomposing the plural-channel audio signal into a number of frequency subband signals;

estimating a first set of powers for two or more channels of the plural-channel audio signal using the subband signals;

estimating a decomposition gain factor using the first set of powers and the cross-correlation; and estimating a second set of powers for the speech component signal and the other component signal from the first set of powers and the cross-correlation, wherein modifying the speech component signal estimates the speech component signal and the other component signal using the second set of powers and the decomposition gain factor, and wherein the generating a modified audio signal synthesizes the subband signals using the estimated speech and other component signals and converts the synthesized subband signals into a time domain plural-channel audio signal having a modified speech component signal wherein the cross-correlation is determined using the first set of powers.

15. An apparatus for processing an audio signal, comprising:

an interface configurable for obtaining a plural-channel audio signal including a speech component signal and other component signals;

a power estimator configurable for:

determining gain values for at least two channels of the plural-channel audio signal, each gain value representing a level for different one channel of the at least two channels; and determining a cross-correlation between the at least two channels;

a signal estimator configurable for:

determining a spatial location of the speech component signal using at least one of the cross-correlation and the gain values; and identifying the speech component signal based on the spatial location of the speech component signal; and a signal synthesizer configurable for:

modifying the speech component signal by applying a gain factor to the speech component signal; and generating a modified audio signal including the modified speech component signal.

16. The apparatus of claim 15, where the speech component signal is modified based on a spectral range of the speech component signal.

17. The apparatus of claim 15, further comprising:

a decomposing unit decomposing the plural-channel audio signal into a number of frequency subband signals, wherein:

the power estimator estimates a first set of powers for two or more channels of the plural-channel audio signal using the subband signals; determines the cross-correlation using the first set of powers; estimates a decomposition gain factor using the first set of powers and the cross-correlation; and estimates a second set of powers for the speech component signal and other component signal from the first set of powers and the cross-correlation;

the signal synthesizer estimates the speech component signal and the other component signal using the second set of powers and the decomposition gain factor; and the signal synthesizer synthesizes the subband signals using the estimated speech and other component signals; and converts the synthesized subband signals into a time domain audio signal having a modified first component signal.

18. A method for processing an audio signal, comprising:

obtaining the audio signal;

obtaining a user input specifying a modification of a first component signal of the audio signal; and modifying the first component signal based on the user input and a location cue of the first component signal, the step for modifying comprising:

decomposing the audio signal into a number of frequency subband signals;

estimating a first set of powers for two or more channels of the audio signal using the subband signals;

determining a cross-correlation using the first set of powers;

estimating a decomposition gain factor using the first set of powers and the cross-correlation;

estimating a second set of powers for the first component signal and a second component signal from the first set of powers and the cross-correlation;

estimating the first component signal and the second component signal using the second set of powers and the decomposition gain factor;

synthesizing subband signals using the estimated first and second component signals; and converting the synthesized subband signals into a time domain audio signal having a modified first component signal.

19. The method of claim 18, wherein the first component signal includes a speech component signal and the second component signal includes an ambience component signal.

20. The method of claim 18, further comprising: modifying the first component signal based on the decomposition gain factor after estimating the first component signal.

* * * * *